US005651400A

United States Patent [19]

Corts et al.

[11] Patent Number: 5,651,400

[45] Date of Patent: Jul. 29, 1997

[54] AUTOMATIC, VIRTUALLY LEAK-FREE FILLING SYSTEM

[75] Inventors: Cornelis Corts; Michael Sebastiaan Corts, both of Maarssen, Netherlands

[73] Assignee: Technology Trading B.V., Zelhem, Netherlands

[21] Appl. No.: 507,433

[22] PCT Filed: Mar. 9, 1994

[86] PCT No.: PCT/EP94/00712

§ 371 Date: Oct. 12, 1995

§ 102(e) Date: Oct. 12, 1995

[87] PCT Pub. No.: WO94/20409

PCT Pub. Date: Sep. 15, 1994

[30] Foreign Application Priority Data

Mar. 9, 1993 [EP] European Pat. Off. ..... 93200672

[51] Int. Cl.[6] ..... B65B 1/04

[52] U.S. Cl. ..... 141/59; 141/198; 141/290; 141/389; 141/DIG. 1; 251/129.2

[58] Field of Search ..... 141/198, 95, 59, 141/285, 286, 290, 383, 384, 386, 392, DIG. 1, 387, 388, 389; 251/129.2, 129.02; 137/522, 521

[56] References Cited

U.S. PATENT DOCUMENTS

| | | | |
|---|---|---|---|
| 2,176,635 | 10/1939 | Mattson | 226/120 |
| 2,201,782 | 5/1940 | McCollum | 251/129.2 |
| 3,692,057 | 9/1972 | Barnd | 251/129.2 |
| 3,807,465 | 4/1974 | Ginsburgh et al. | 1441/285 |
| 4,441,533 | 4/1984 | Snyder | 141/59 |
| 4,907,630 | 3/1990 | Kulikowski et al. | 141/384 |
| 5,131,439 | 7/1992 | Bucci | 141/59 |
| 5,355,915 | 10/1994 | Payne | 141/59 |

FOREIGN PATENT DOCUMENTS

| | | |
|---|---|---|
| 2 300 951 | 9/1976 | France . |
| 2 421 143 | 10/1979 | France . |

*Primary Examiner*—Henry J. Recla
*Assistant Examiner*—Steven O. Douglas
*Attorney, Agent, or Firm*—Young & Thompson

[57] ABSTRACT

An automatic virtually leak-free filling system for filling a liquid tank (1), comprises a bulk supply tank (3), a pump (12, 22) and a liquid line (5, 11) connected to the bulk supply tank which at its open end is provided with a coupling (9) for a manually detachable, virtually leak-free to a filling neck (25) of a liquid inlet (10) to the liquid tank (1). The system is moreover furnished with an overfill protection circuit which automatically cuts off the liquid supply to the liquid tank (1) on reaching a predetermined filling level in the liquid tank (1). According to the invention, the liquid tank (1) is furnished with a localized vapour outlet (15) which, at least during operation, connects to a vapour return line (13). The overfill protection circuit comprises a float valve (20) which is capable of cutting off the vapour return line (13) when the predetermined filling level is reached. The overfill protection further comprises a vapour flow detector (16) which is interposed in the vapour return line (16) and is capable of producing an electrical output signal when any vapour in the vapour return line (13) ceases to flow. This output signal is fed to the pump (12, 22) causing the further supply of liquid to be cut off.

10 Claims, 4 Drawing Sheets

AUTOMATIC, VIRTUALLY LEAK-FREE FILLING SYSTEM

BACKGROUND OF THE INVENTION

1. Field of the Invention

The invention relates to an automatic, virtually leak-free filling system for filling a liquid tank, comprising a bulk supply tank, a liquid line at one end connected to the bulk supply tank and at the opposite end fitted with coupling means for a manually detachable, virtually leak-free coupling to a filling neck of a liquid inlet to a liquid tank, pump means for transport of liquid from the bulk supply tank to the liquid tank, and comprising overfill protection means for automatically cutting of the liquid supply to the liquid tank when a predetermined filling level has been reached in the liquid tank. The invention furthermore relates to an adaptor and a pressure pulse valve for use in such a system.

In this respect it is noted that both the liquid tank and the bulk supply tank may be either stationary or mobile. The liquid tank may for instance be a vehicle fuel tank which is to be filled from a bulk supply tank of a refuelling station. However likewise it is for instance possible that the liquid tank is stationary and is filled from a mobile bulk supply tank of for instance a tank lorry, wagon or ship. Moreover the invention is not limited to a system for filling fuels but may likewise be applied for filling of other liquids.

The leakage of liquids often poses a considerable threat to the environment. By using a system of the type described in the opening paragraph, such threat can be avoided as said system provides for virtually leak-free filling so any spilling of liquid is counteracted. This is of course of particular interest for liquids which may pollute the environment such as fuels and harmful chemicals. However, also for liquids which are less harmful to the environment may a system of the type referred to in the opening paragraph be used advantageously, as in any case waste of the liquid concerned is avoided.

2. Description of the Related Art

An existing automatic, virtually leak-free filling system, used for filling vehicle fuel tanks from a bulk supply tank, comprises pump means in the form of a pump installation whereby fuel is pumped from the bulk supply tank to the vehicle fuel tank via a flexible fuel hose. The fuel hose is coupled virtually leak-free to a filling neck of the vehicle tank by means of a virtually leak-free quick-connection coupling which is mounted to the open end of the fuel hose. To prevent the fuel tank from being overfilled, the existing system contains overfill protection means in the form of an electronic liquid sensor which is contained in the vehicle fuel tank. When the fuel in tank reaches said sensor, it produces an electrical output signal that causes the supply of further fuel to be stopped automatically.

The existing automatic, virtually leak-free filling system has however the drawback that the liquid sensor has to be built into the vehicle fuel tank, which therefore has to be opened up. Especially for existing vehicles, this causes considerable costs due to the rather long time needed for fitting and the associated withdrawal from operation of the vehicle. Moreover, the liquid sensor used reacts rather slowly, which renders the existing system less suitable for filling at relatively high rates up to, for example, 150 litres per minute. At such high filling rates the further supply of fluid needs to be cut off extremely fast, particularly to avoid that the pressure within the liquid tank does not rise to an inadmissible level. A further drawback of the known system is the necessity of a separate electrical connection to the (sensor within) the liquid tank. When this connection is forgotten, at the best merely liquid will run out of the liquid tank once its maximum filling level is exceeded but it is even possible that the liquid tank will explode due to an inadmissible rise of its internal pressure.

SUMMARY OF THE INVENTION

The present invention has inter alia for its object to provide an automatic, virtually leak-free, filling system of the type described in the opening paragraph, with overfill protection means which can be easily and quickly built into both new and existing vehicles, and which offers adequate protection against overfilling and an inadmissible pressure rise of the liquid tank even at relatively high filling rates of, for example, 150 litres per minute.

To this end, an automatic, virtually leak-free, filling system of the type described in the opening paragraph is according to the invention characterized in that the liquid tank is provided with a localized vapour outlet, in that, at least during operation, a vapour return line is connected to said vapour outlet, and in that the overfill protection means comprise a float valve, capable of cutting off the vapour return line when said predetermined filling level is reached, and a vapour flow detector interposed in the vapour return line, capable of producing an electrical output signal when any vapour in the vapour return line ceases to flow, and in that the vapour flow detector is electrically coupled to the pump means such that the liquid supply is cut off on the occurrence of said output signal.

Vapour which is expelled from the liquid tank during filling, leaves the liquid tank only via the vapour outlet and the vapour return line connected to it. However, when the liquid reaches the float valve, the float valve cuts off the vapour outlet which causes the flow of vapour in the vapour return line to stop. Thereupon the vapour flow detector produces an electrical output signal which is fed to the pump means and virtually instantaneously causes the supply of further liquid to be stopped. The system according to the invention appears sufficiently fast to avoid any inadmissible pressure increase in the liquid tank, even at relatively high filling rates of, for example, 150 litres per minute, and accordingly provides an adequate protection against overfilling.

Moreover, the automatic, virtually leak free filling system according to the invention merely requires the liquid tank to be fitted with a localized vapour outlet and a float valve. This can be realized on both new and existing tanks without having to open them up and in quite a short time.

Within the scope of this application, the term vapour should be interpreted to include not simply the purely gaseous phase of the liquid concerned but also mixtures of it with other gasses or gas mixtures such as air in particular.

It is noted that from U.S. Pat. No. 2,176,635 it is known per se to furnish a liquid tank with a localized vapour outlet which connects to a vapour return and to cut off the further supply of liquid to the liquid tank once any vapour in the vapour return line ceases to flow. This known automatic filling system however does not comprise any pump means and moreover is entirely unsuitable for pressurized filling at comparatively high filling rates due to the purely mechanical nature of the control valve and the detection means disclosed.

A preferred embodiment of the system according to the invention is characterized in that the liquid inlet to the liquid tank is provided with both the filling neck and the vapour outlet, that an inlet of the float valve is in open communication with the liquid tank and an outlet of the float valve is in open communication with the vapour outlet, in that at least either the inlet or the outlet of the float valve is connected to a float pipe of predetermined length and in that the coupling means comprise a virtually leak-free quick connection coupling which is capable of mating with the filling neck to establish a virtually leak-free mutual connection as well as a co-axial chamber which comprises the vapour outlet in one of its walls and is in open communication with the vapour line.

This embodiment provides for a single-point connection of the liquid supply line together with the vapour return line to the liquid tank. When the quick-connection coupling is coupled to the filling neck, the vapour return line is connected simultaneously. Besides from a practical point of view this is especially advantageous because in this manner it is assured that the overfill protection means are operational each time the liquid supply line is connected. The length of the float pipe ultimately determines the maximum extent to which the liquid tank can be filled.

The float pipe may be easily fitted in the liquid tank via the liquid inlet, without having to open up the liquid tank.

To simplify the installation of the overfill protection means to the liquid tank, a special embodiment of the automatic, virtually leak-free filling system according to the invention is characterized in that the filling neck and the vapour outlet are part of an adaptor which comprises a base part mating with the liquid inlet. The adaptor can be quickly and accurately fitted to the liquid inlet of the liquid tank. This can be carried out in quite a short period of time even on a fuel tank of an existing vehicle as the dimensions of the base part may be matched beforehand to the dimensions of the liquid inlet. The base part may contain, for example, an internal or external thread, a part of the bayonet connection or a bored recess which mates with a complementary part on the liquid inlet. If desired, the adaptor may be rigidly secured to the liquid inlet by means of for example a suitable cement or a locking pin. With such an adaptor, generally the present invention merely involves the replacement of the existing filler cap of the liquid inlet by the adaptor, without requiring any further modification of the liquid tank. Accordingly, generally the vehicle does not need to be taken out of service or at least not for long.

By adjusting the dimensions of the base part of the adaptor, the adaptor may be rendered suitable for a wide variety of liquid tanks. According to a preferred embodiment, the filling neck and a base part of the adaptor constitute separate pans which are mutually connected. In that case only different base parts will need to be kept in stock along with one standard filling neck which can be mounted on them. After fitting together, both parts may be secured to one another by means of for example a suitable cement or a locking pin.

In addition the materials of both parts can thereby be chosen to suit the particular function of each part. For example, the base part can be made of aluminium, which is easy to shape and work, and the filling neck can be made of stainless steel which wears less and is therefore more resistant against repeated coupling and decoupling of the coupling means.

In a further embodiment, the base part of the adaptor comprises an inlet duct across from the filling neck which is inserted in the liquid inlet of the liquid tank. Said inlet duct preferably extends nearly to the bottom of the tank. In this manner it is assured that the tank is filled underneath the liquid level. This is of particular advantage to the filling of gasoline or other liquids which easily give rise to excessive effervesce if they are filled above the liquid surface.

A further embodiment of the filling system according to the invention is characterized in that the vapour line is openly connected at its second end to the bulk supply tank. Thus the vapour which expelled from the liquid tank is returned to the bulk supply tank. In this manner any leakage of vapour to the environment is counteracted, so that the system is rendered both leak-free and vapour-free. The bulk supply tank can be fitted with a suitable air separator to remove any air from the vapour for release to the environment.

In a special embodiment a vapour pump is included in the vapour return line to overcome the resistance of the line. This is to ensure that also with long vapour return lines there is a sufficiently high vapour flow so that the pressure in the liquid tank will not rise to an unacceptable level.

A specific further embodiment of the filling system according to the invention is characterized in that the pump means comprise a pressure pulse valve which is interposed in the liquid line and which comprises a valve housing accommodating a cutoff valve which pivots around an axis extending traverse to the flow direction, in that the pressure pulse valve comprises an electromagnet which releases a pin under influence of an electrical control signal in that the valve housing is provided at the area of the cutoff valve with a hole to accommodate said pin and in that the vapour flow detector is electrically coupled to said electromagnet.

In this embodiment, the electrical output signal of the vapour flow detector is fed to the electromagnet of the pressure pulse valve, either directly or via a microprocessor or another electronic circuit. As a consequence, when the vapour in the vapour return line ceases to flow, the electromagnet releases the pin which causes the cutoff valve to be lifted into the liquid stream. The liquid itself then further forces the cutoff valve to close down the liquid flow entirely. A pressure pulse valve of this kind has proven to be extremely fast and renders the filling system suitable for filling rates which even may exceed 150 litres per minute.

BRIEF DESCRIPTION OF THE DRAWINGS

The invention will be further described by means of an example and associated drawings. In the drawings.

The figures are purely schematic and not drawn to scale. In particular, for clarity, some dimensions have been strongly exaggerated. Generally, corresponding parts in the figures are indicated by the same reference numbers.

DESCRIPTION OF THE PREFERRED EMBODIMENTS

Figure 1:
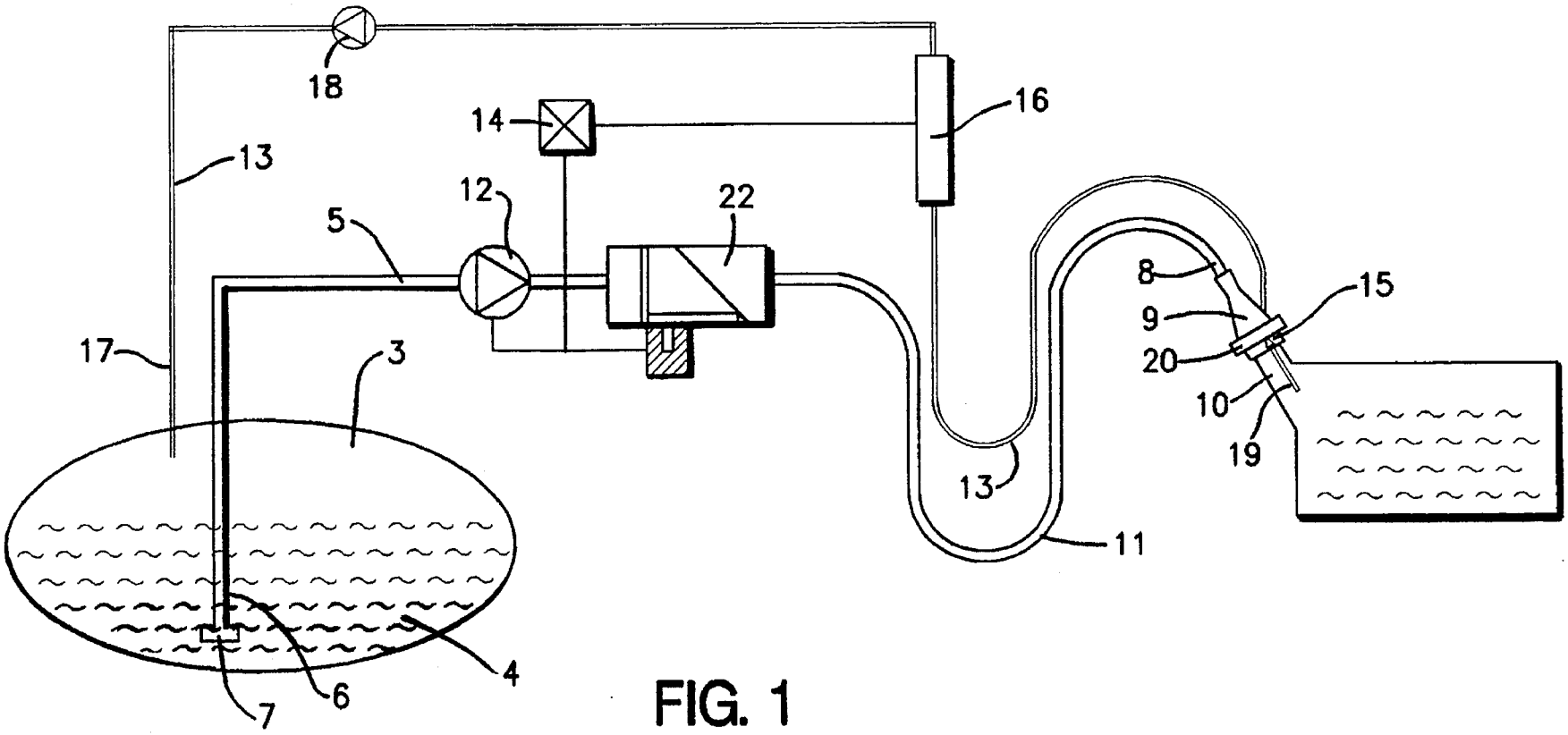
FIG. 1 shows a schematic representation of a particular embodiment of the automatic, virtually leak-free filling system according to the invention.

In the embodiment shown in FIG. 1, the automatic, virtually leak-free filling system of the invention is used for fuelling busses which are equipped with a liquid tank 1 having a capacity of the order of 300 litres fuel. For clarity, FIG. 1 does not show the entire bus but merely its fuel tank 1. Besides for fuelling busses, the system of the invention might as well be used for filling other types of vehicles such as for instance cars, trucks, ships and aircraft.

The fuel tank 1 of the bus is filled by means of a liquid line 5, 11 from a pump installation comprising a bulk supply tank 3 containing a stock of fuel 4 and pump means comprising a conventional fuel pump 12. In this example, the fuel pump 12 in fact comprises a series arrangement of three separate fuel pumps, each having a capacity of approximately 40 litres per minute, in order to establish a total pump capacity of about 120 litres per minute. Consequently the fuel tank 1 may be completely filled in less than three minutes. The bulk supply tank 3 may for instance be an underground storage tank of a refuelling station.

A first end 6 of the liquid line 5 is connected to the bulk supply tank 3 and communicates via a conventional filter 7 with the fuel 4 in the tank 3. At the opposite side, the liquid line ends in a flexible fuel hose 11 which at its open end 8 is fitted with coupling means 9 for a manually detachable, virtually leak-free connection to a filling neck 25, see FIG. 4, of a liquid inlet 10 of the fuel tank 1. In this embodiment, the coupling means comprise a conventional virtually leak-free quick connection coupling which is capable of mating with the filling neck 25 of the fuel tank 1 to establish a virtually leak-free connection and cuts off the end of the fuel hose 11 once it is disconnected from the filling neck 25.

When the quick connection coupling is connected to the liquid inlet 10 of the liquid tank 1, a vapour return line 13 is simultaneously connected to a localized vapour outlet 15 provided in accordance with the invention on the liquid tank 1. The vapour return line 13 may partly or entirely consist of a flexible hose, typically of about 12 mm. internal diameter. Although strictly not necessary for the present invention, the vapour return line 13 is preferably connected at the opposite end 17 to the bulk supply tank 3, like in this embodiment, or any other closed reservoir to prevent any fuel vapour from entering the environment. A comparatively light vapour pump 18 is included in vapour return line 13 to overcome the resistance of the line 13 so that during filling the pressure in fuel tank 1 does not rise to an unacceptable level. With a shorter and/or wider vapour return line 13 such a vapour pump may possibly be dispensed with.

To prevent the liquid tank 1 from being filled too much, which would cause fuel running out of the tank 1 or, even worse, might lead to an unacceptable pressure rise within the tank 1, the system contains overfill protection means which automatically cut off the fuel supply on reaching a predetermined fuel level in the fuel tank 1. According to the invention, the overfill protection means comprise a float valve 20 capable of cutting off the vapour outlet 15 once said predetermined fuel level is reached as well as a vapour flow detector 16 which is interposed in the vapour return line 13 and is capable of generating an electrical output signal when any vapour in the vapour return line ceases to flow. The float valve 20 is connected at its first end to a float pipe 19 of predetermined length and at its second end to the vapour outlet 15. The float pipe 19 may, or may not, be flexible. In the example shown here the float pipe 19 is made of a metal tube with an internal diameter of approximately 12 mm., matching the internal diameter of the vapour return line 13.

During filling a vapour mixture of fuel and air residing above the fuel surface, is expelled from the fuel tank 1 via the vapour outlet 15 and the vapour return line 13. At a constant filling rate, a constant vapour flow will be present within the vapour return line 13. However, once the fuel reaches the float valve 20, the float valve 20 immediately cuts off the vapour return line 13, so any vapour flow ceases immediately. Thereupon, the vapour flow detector 16 produces an electrical output signal which is fed to the pump means 12 via a control unit 14 which may include a microprocessor and/or other electronic circuitry conceivable per se to a skilled person, in order to switch off the fuel pump 12 and to activate an electrical cutoff valve 22. As a result, any further supply of fuel is stopped nearly instantaneously.

The cutoff valve 22 ensures that any inevitable further rotation of the pump 12 after being switched off does not cause any more fuel to be supplied to the tank 1, which might otherwise lead to an unacceptable pressure rise in the tank 1 as the float valve 20 has meanwhile closed the vapour outlet 15. This is especially important with comparatively high filling rates as in the instant example. To counteract unacceptable pressure pulses in the liquid line 5, 11 once it is cut off, the pump installation may moreover be equipped with automatic, hydraulic control valves, shunts and dampers. At moderate filling rates these measures may be dispensed with.

Because the fuel reaches the float valve 20 through the float pipe 19, the length of the float pipe 19 ultimately determines the maximum filling level, which can be easily adjusted beforehand to meet the desired filling degree.

Even at a relatively high filling rate of 120 litres per minute employed in this example, the filling system of the invention has proven to be capable of maintaining the pressure within the liquid tank 1 below 0,05 bar under all circumstances, which is more than acceptable in practice for most common vehicle tanks 1.

Figure 2:
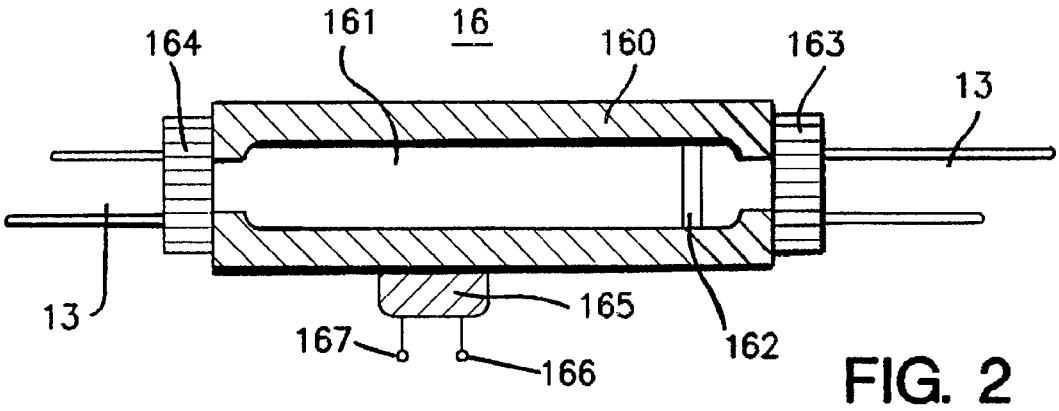
FIG. 2 shows a cross-section of a particular embodiment of a vapour flow detector applicable in the system of FIG. 1.

FIG. 2 shows a possible embodiment of the vapour flow detector 16. The detector 16 comprises a detector housing 160 with a cavity 161 to accommodate a freely movable piston 162 which comprises a permanently magnetic material. The detector housing 160 is interposed in the vapour return line 13 via an inlet 163 and an outlet 164 so the cavity 161 communicates at both sides with the vapour return line. A Reed-relay 165 is mounted externally to the detector housing 160 and comprises an electrical input contact 166 and output contact 167.

During operation, the piston 162 is carried along with the vapour flowing through the vapour return line 13. Accordingly the magnetic piston 162 will pass the Reed-relay when any vapour starts to flow through the vapour return line 13, which causes the Reed-relay to be switched on and an electrical connection between both contacts 166, 167 to be established. This connection remains intact as long as there is sufficient vapour flow. Consequently, an output voltage may be taken from the output contact 167 which is practically equal to the input voltage supplied to the input contact 166.

However, as soon as the vapour ceases to flow, the piston 162 almost immediately returns to its initial position and thereby passes the Reed-relay 165 for the second time, so breaking the connection between both contacts 166 and 167. At that time the voltage on the output contact 167 will return to its initial level. Accordingly the voltage at the output contact 167 of the Reed-switch represents the actual status of the vapour flow in the vapour return line 13 and hence forms an electrical output signal which can be used to control the pump installation.

Figure 3:
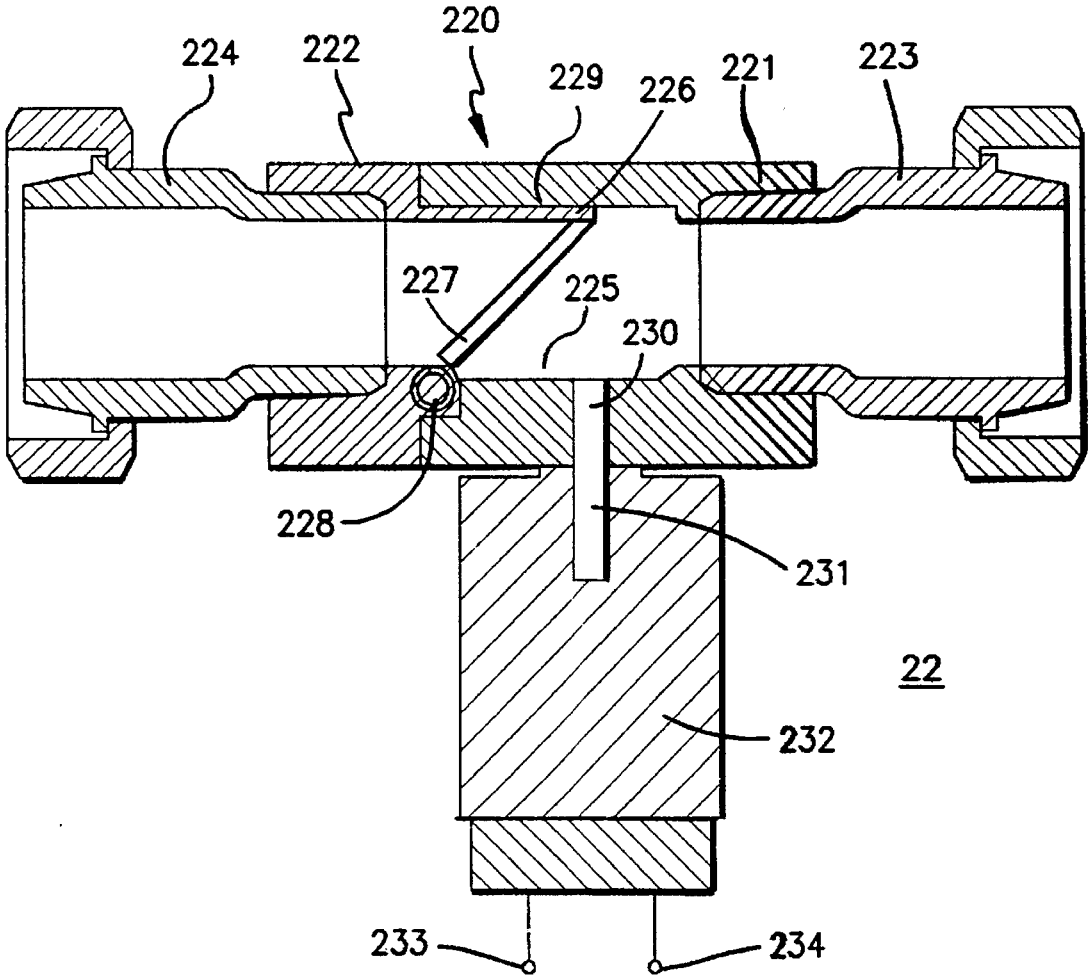
FIG. 3 shows a cross-section of a pressure pulse valve according to the invention.

A preferred embodiment of the cutoff valve 22 is shown in detail in FIG. 3 and, according to the invention, consists of an electrically controllable pressure pulse valve. The pressure pulse valve 22 of FIG. 3 comprises a valve housing 220 and is provided with hose couplings 223 and 224 at the inlet 221 and outlet 222 side respectively in order to facilitate its fitting into a liquid line. The valve housing 220 contains a valve seating 225 in the form of a depression on the inside wall which accommodates a cutoff valve 226 in its rest position. In that position, the valve 226 lies sunk in the wall so as to present no resistance to any liquid flowing through the valve housing 220. At its side 227 across from the inlet 221, the cutoff valve 226 pivots around an axis 228 which extends traverse to the flow direction. Opposite to the valve seating 225, the housing 220 is internally provided with a valve stop 229 which cooperates with the cutoff valve 226 to seal off the valve housing 220 hermetically in its closed state (as drawn).

A hole 230 is bored in the wall of the valve housing 220 at the area of the seating 225 to accommodate a pin 231 of an electromagnet 232 attached to the outside of valve housing 220. Suitable packing means are interposed between the electromagnet 232 and the valve housing 220 to prevent leakage. The pin 231 constitutes the armature of the electromagnet 232 and is released by said magnet when the latter is electrically activated. The electromagnet may be coupled to the vapour flow detector 16 by means of electrical connections 233 and 234.

Applied in the system of FIG. 1, the electromagnet 232 is energized when it receives a suitable electrical signal via the control unit 14 from the vapour flow detector 16. In its turn the electromagnet 232 releases the pin 231 which slides through the bored hole 230 to hit the cutoff valve 226. As a result, the cutoff valve 226 is lifted from its seating 225 and pushed a little into the liquid stream, flowing trough the housing. The (pressure of the) liquid stream itself subsequently ensures that the cutoff valve is forced against the valve stop 229, cutting off the valve housing 220 completely. This all takes place in merely a fraction of a second, which renders the pressure pulse valve according to the invention especially suitable for the automatic filling system according to the invention as it ensures a reliable and extremely fast cut off of any liquid supply once it is activated. In practice, the pressure pulse valve according to the invention has proved capable of reaching switching times of less than 10 ms which is sufficiently fast to handle filling rates of 150 litres per minute or even more.

Figure 4:
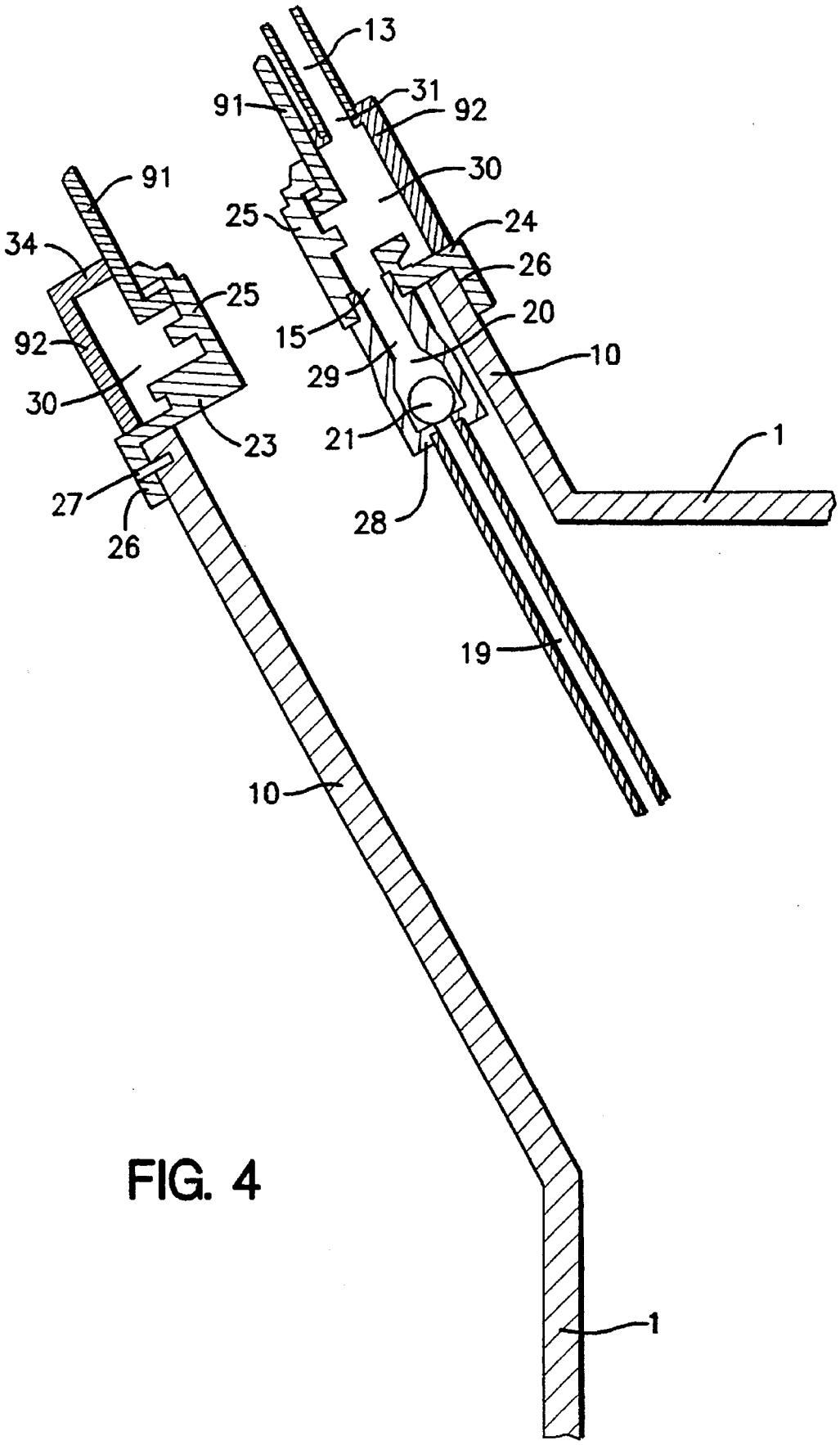
FIG. 4 shows a detailed cross-section of an embodiment of a liquid tank adapted to the filing system of the invention.

FIG. 4 shows a detailed cross-section of a part of the system of FIG. 1, including the liquid tank 1 furnished with virtually leak-free coupling means 91, 92 to a filling neck 25 of its liquid inlet 10. For sake of clarity, the figure merely shows part of the wall of the fuel tank 1. The filling neck 25 is provided on a base part 24 of an adaptor 23 which moreover includes the vapour outlet 15 and is shown in top view in FIG. 5. The adaptor is rigidly secured in a leak-free manner to the liquid inlet 10 of the tank 1. To this end, the base part 24 of the adaptor is provided with a bored recess 26 which mates with the liquid inlet 10 and which may be provided with a suitable screw thread or part of bayonet fitting mating a complementary screw thread or part of a bayonet fitting present on the liquid inlet in order to hold a filler cap. In that case the provision of the adaptor 23 according to the invention merely requires the replacement of said filler cap by the adaptor 23, which does not have to take long even in case of a fuel tank of an existing vehicle. As a result a vehicle generally need not be taken out of service in order to adapt it to the filling system according to the invention, which obviously saves considerable costs. A suitable filler cap, not shown, may be provided on the adaptor 23 when the coupling means are disconnected to close the liquid inlet 10.

The adaptor 23 is secured to the liquid inlet 10 by means of a locking pin 27. Alternatively or additionally a suitable cement between the inlet 10 and the adaptor 13 may be used for this purpose. If necessary, a suitable sealing material can be used between the adaptor 23 and the liquid inlet 10 to ensure a leak-tight connection.

At a side across from the filling neck 25, the adaptor 23 is fitted with the float valve 20. An inlet 28 of the float valve 20 is in open communication with the liquid tank 1 via the float pipe 19 of predetermined length extending into the tank 1, whereas an outlet 29 of the float valve 20 is in open communication with the vapour outlet 15. The float valve contains a float formed by a ball 21 of polypropylene. In this respect it is noted that the expression "float" should not be interpreted too literally. In fact the float ball 21 preferably has a specific weight about the same or even somewhat larger, like in this example, than the density of the fuel 4. The float ball 21 will nevertheless be carried along and eventually pushed against the outlet 29 by the rising fuel when the latter reaches the float valve 20 via the float pipe 19. The comparatively large weight of the float ball 21 however ensures that it is not carried along with the vapour flow already and moreover aids its release from the outlet 29 when the liquid has again dropped below the maximum filling level. Once the float ball 21 is pushed against the outlet 29, it hermetically cuts off the vapour outlet 15, causing any vapour flow in the vapour return line 13 to cease.

The coupling means 9 consists in itself of an existing, commercially obtainable and virtually leak-free filling pistol 91, of which only a part is drawn, capable of mating with the filling neck 25 to establish a leak-free connection. The quick-connection coupling couples onto filling neck 25 and further comprises a sleeve 92 which is secured to the filling pistol 91 and presses against a flange of the base part 24 of the adaptor 23 to establish an air-tight interface. Either the base part 24 or the sleeve 92 may be provided with proper sealing means to ensure this air-tight connection. Accordingly the quick-connect coupling 91, 92 and the filling neck 25 together form a virtually air-tight chamber 30 co-axial with the filling neck 25, an inside wall of the chamber being formed by the filling neck 25 and an outside wall of the chamber being formed by the sleeve 92. On the one hand, the chamber 30 comprises the vapour outlet 15 of the liquid tank 1 and on the other it is provided with a vapour exit 33 which connects to the vapour line 13. This construction provides for a very convenient single-point connection to the liquid tank 1, ensuring that the vapour return line 13 is always properly connected to the vapour outlet 15 once the coupling means 9 are applied to the filling neck 25. Accordingly it is ensured that the overfill protection means of the invention are operational each time a liquid tank 1 is being filled.

Figure 5:
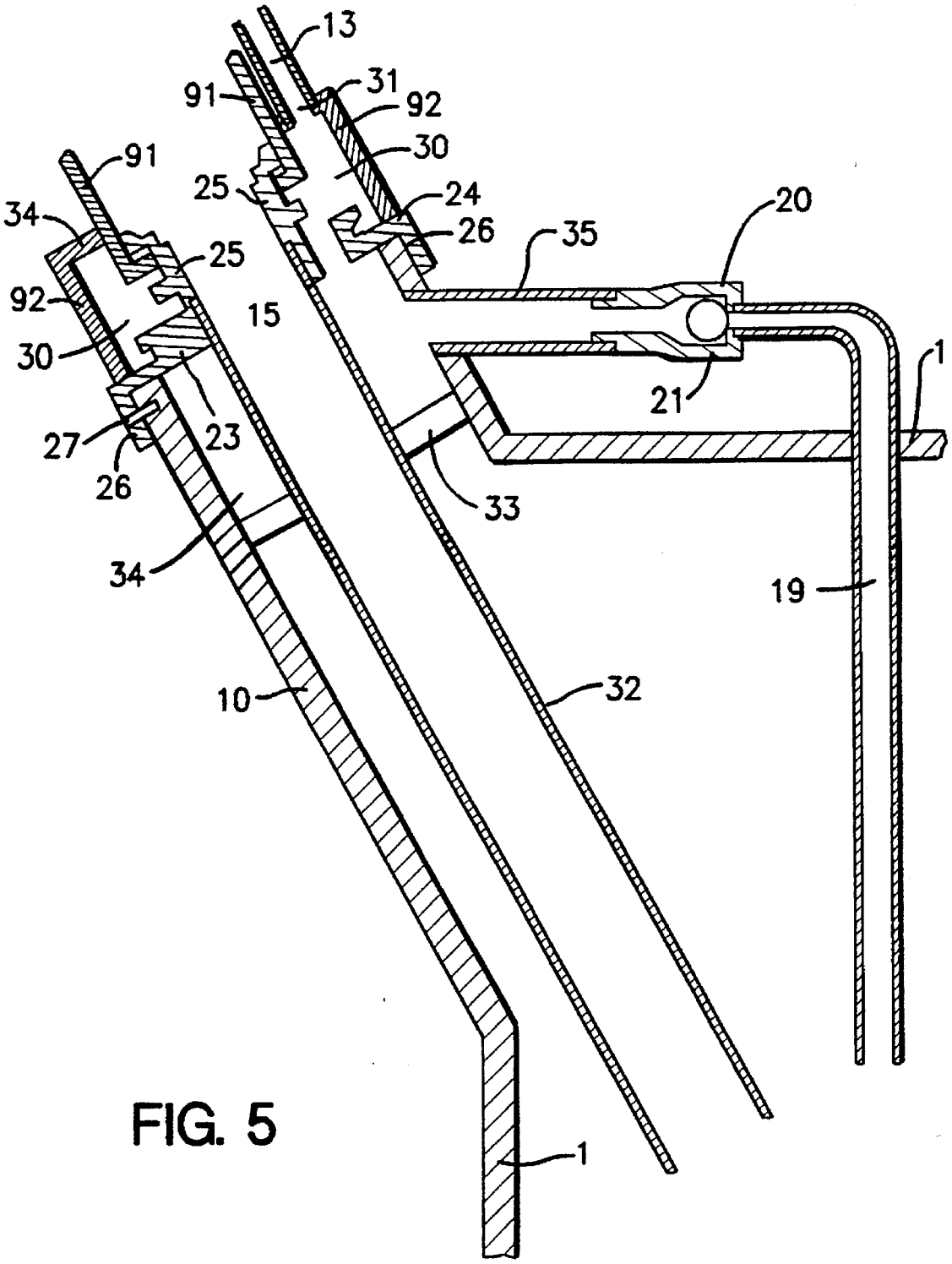
FIG. 5 shows a detailed cross-section of an alternative embodiment of a liquid tank adapted to the filling system of the invention.

An alternative embodiment of a liquid tank 1 adapted to the filling system according to the invention is depicted in FIG. 5. In this embodiment the inlet 10 of the liquid tank 1 is fitted with an adaptor 23 which besides a filling neck 25 and a vapour outlet 15 moreover comprises an inlet duct 32 across from the filling neck 25. The filling duct is inserted in the inlet 10 of the tank 1 and extends nearly to the bottom of the tank 1. This embodiment facilitates filling of the liquid tank 1 below the liquid level while the tank has its inlet 1 at the top. This is particular advantage to the filling of gasoline or any other liquids which readily give rise to froth forming as any effervesce is counteracted by filling below the liquid surface. Accordingly it is ensured that the tank 1 is filled entirely up to the desired filling level.

Away from the adaptor 23 a suitable sealing 33 has been provided between the inlet duct 32 and the inner wall of the liquid inlet 10 to close an air-tight chamber 34 within the latter. Said chamber comprises the vapour outlet 15 in one of its walls and is connected by a duct 35 to the float valve 20 which is provided outside the liquid tank 1 in this embodiment. The float valve 20 is connected to the (interior of) the liquid tank 1 by means of a float duct 19 of predetermined length which, like in the preceding embodiment, ultimately determines the maximum filling level. The operation of the float valve 20 is fairly insensitive to its specific orientation as the float ball 21 in it will eventually be carried along by the liquid as it reaches the float valve 20. Accordingly it may even be mounted horizontally, like in this example, without giving rise to malfunction.

While the invention has been explained in greater detail with reference to merely a few embodiments, it will be clear that the invention is in no way limited to these embodiments only. On the contrary, within the scope of the invention, it is possible for the skilled craftsman to produce still more variations and forms.

For instance it is noted that while, in the examples given, a separate liquid line and vapour line are used, in practice, both lines can be arranged coaxially. Moreover in stead of one single localized vapour outlet, the liquid tank may be provided with a number of localized vapour outlets each being connected to a vapour line whether in common or not.

In addition, instead of being in one piece, as in the examples, the adaptor according to the invention can, and preferably does, comprises a filling neck and a base part which are mutually detachably connected. This has the advantage that only a selection of different base parts need be kept in stock to suit the different kinds of liquid inlets of liquid tanks that occur in practice. The filling neck need only be held in stock in one universal, standard version. Moreover the materials of both parts may in that case be chosen to suit their particular function. In this respect, for example, the base part is preferably made of aluminium or any other light material which is easy to shape and to process, and which, due to its low weight, presents only a relatively light load on the frequently weak liquid inlet of a liquid tank. On the other hand the filling neck comprises preferably, for example, hard stainless steel to resist wear resulting from repeated coupling and de-coupling of the coupling means.

Further, the vapour flow detector need not be devised on basis of a Reed-relay. Alternatively it may for instance be equipped with a photo-sensor separated from an associated transmitter by a transparent cavity accommodating an opaque piston. In that case an electrical output signal is delivered, similar to the Reed-relay, when the piston traverses the light path between the photo-sensor and the transmitter.

Further in stead of being used to fill a vehicle fuel tank, the system according to the invention may likewise advantageously be used to fill any other mobile or stationary liquid tank regardless whether it has its liquid inlet at the top or at the bottom. In particular when poisonous and volatile liquid chemicals are involved, the system according to the invention adequately protects the environment as both any spoiling of the liquid concerned as well as of its vapour may be avoided.

In general the invention provides for an automatic and virtually leak-free filling system that functions reliably and fast up to high filling rates, is easy to handle and only requires a minor adaption of the tank to be filled without having to open it up.

We claim:

1. Automatic, virtually leak-free filling system for filling a liquid tank (1) comprising a bulk supply tank (3), a liquid line (5, 11) at one end connected to the bulk supply tank (3) and at the opposite end fitted with coupling means (9) for a manually detachable, virtually leak-free coupling to a filling neck (25) of a liquid inlet (10) to the liquid tank (1), pump means (12, 22) for transport of liquid from the bulk supply tank (3) to the liquid tank (1), and comprising overfill protection means (12, 14, 16, 22) in electrical and fluid communication with said pump means, for automatically cutting of the liquid supply to the liquid tank (1) when a predetermined filling level has been reached in the liquid tank (1), the liquid tank (1) being provided with a localized vapour outlet (15) which, at least during operation, connects to a vapour line (13) and with a float valve (20) mounted adjacent said coupling means (9) and capable of cutting off the vapour line (13) when said predetermined filling level is reached, and a vapour flow detector (16) comprised by said overfill protection means being interposed in the vapor line (13), characterized in that the vapour flow detector (16) is capable of producing an electrical output signal when any vapour in the vapour line (13) ceases to flow, and in that the vapour flow detector (16) is electronically coupled to the pump means (12, 22) such that the liquid supply is cut off on the occurrence of said output signal.

2. Automatic, virtually leak-free filling system according to claim 1 characterized in that a liquid inlet (10) to the liquid tank (1) is provided with both the filling neck (25) and the vapour outlet (15), in that an inlet (28) of the float valve (20) is in open communication with the liquid tank (1) and an outlet (29) of the float valve (20) is in open communication with the vapour outlet (15), in that at least either the inlet (28) or the outlet (29) of the float valve (20) is connected to a float pipe (19) of predetermined length and in that the coupling means (9) comprise a virtually leak-free quick connection coupling (91) which is capable of mating with the filling neck (25) to establish a virtually leak-free mutual connection as well as a co-axial chamber (30) which comprises the vapour outlet (15) in one of its walls and is in open communication with the vapour line (13).

3. Automatic, virtually leak-free filling system according to claim 1 characterized in that the filling neck (25) and the vapour outlet (15) are part of an adaptor (23) which comprises a base part (24) mating with the liquid inlet (10), in that the base part (24) of the adaptor (23) comprises a flange surrounding both the filling neck (25) and the vapour outlet (15) which is capable of establishing a substantially air-tight mutual connection with a sleeve (92) which is associated with the quick connection coupling (91) and which is in open communication with said vapour line (13), and in that said sleeve (92) together with the adaptor form the co-axial chamber (30).

4. Automatic, virtually leak-free filling system according to claim 3 characterized in that the filling neck (25) and the base part (24) of the adaptor (23) constitute separate parts which are mutually connected.

5. Automatic, virtually leak-free filling system according to claim 3 characterized in that the base part (24) of the adaptor (23) comprises an inlet duct (32) across from the filling neck (25) and in that said inlet duct (32) is inserted in the liquid inlet (10) to the liquid tank (1).

6. Automatic, virtually leak-free filling system according to claim 1 characterized in that a second end (17) of the vapour line (13) is in open communication with the bulk supply tank (3).

7. Automatic, virtually leak-free filling system according to claim 6 which is characterized in that a vapour pump (18) is interposed in the vapour line (13).

8. Automatic, virtually leak-free filling system according to claim 1 characterized in that the pump means (12, 22) comprise a pressure pulse valve (22) which is interposed in the liquid line (5, 11) and which comprises a valve housing (220) accommodating a cutoff valve (226) which pivots around an axis (228) extending traverse to the flow direction, in that the pressure pulse valve comprises an electromagnet (232) which releases a pin (231) under influence of an electrical control signal, in that the valve housing is provided at the area of the cutoff valve (226) with a hole (230) to accommodate said pin (231) and in that the vapour flow detector (16) is electrically coupled to said electromagnet (232).

9. Adaptor for use in an automatic, virtually leak-free filling system comprising a localized vapour outlet (15) and a base part (24) capable of mating with a liquid inlet (10) of a liquid tank (1) characterized in that the adaptor (23) moreover comprises a filling neck (25) including a terminal outlet and being capable of establishing a substantially leak-free connection to a quick-connection coupling (91), the localized vapour outlet and the filling neck both extending transversely through the base part, and in that the base part (24) of the adaptor (23) comprises a flange surrounding both the terminal outlet of the filling neck (25) and the vapour outlet (15) which is capable of establishing a substantially air-tight mutual connection with a sleeve (92) which is associated with the quick-connection coupling (91) and which is in open communication with a vapour line (13) connected to said sleeve.

10. Pressure pulse valve for use in an automatic, virtually leak-free filling system characterized in that it comprises a valve housing (220) accommodating a cutoff valve (226) which pivots around an axis (228) extending traverse to the flow direction, in that it comprises an electromagnet (232) which releases a pin (231) under influence of an electrical control signal, in that the valve housing is provided at the area of the cutoff valve (226) with a hole (230) to accommodate said pin (231), and in that a vapour flow detector (16) associated with said filling system is electrically coupled to said electromagnet (232).

* * * * *